US009728903B2

(12) United States Patent
Long et al.

(10) Patent No.: US 9,728,903 B2
(45) Date of Patent: Aug. 8, 2017

(54) WAFER FOR ELECTRICAL CONNECTOR

(71) Applicant: Molex, LLC, Lisle, IL (US)

(72) Inventors: Jerry A. Long, Elgin, IL (US); Eric A. Deichmann, Naperville, IL (US); Daniel Tillotson, Wheaton, IL (US); Michael P. Flynn, Naperville, IL (US); Justin Hoyt, Wheaton, IL (US); Jerber Mendoza, Aurora, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/140,672

(22) Filed: Apr. 28, 2016

(65) Prior Publication Data

US 2016/0322760 A1 Nov. 3, 2016

Related U.S. Application Data

(60) Provisional application No. 62/154,838, filed on Apr. 30, 2015, provisional application No. 62/162,368, filed on May 15, 2015.

(51) Int. Cl.

| | |
|---|---|
| ***H01R 13/648*** | (2006.01) |
| ***H01R 13/6587*** | (2011.01) |
| ***H01R 12/72*** | (2011.01) |
| *H01R 13/6471* | (2011.01) |

(52) U.S. Cl.
CPC ..... *H01R 13/6587* (2013.01); *H01R 12/724* (2013.01); *H01R 13/6471* (2013.01)

(58) Field of Classification Search
CPC H01R 13/6587; H01R 13/648; H01R 13/514; H01R 43/04; H01R 12/716
USPC ..... 439/607.07
See application file for complete search history.

(56) References Cited

U.S. PATENT DOCUMENTS

| | | | | |
|---|---|---|---|---|
| 6,347,962 | B1 * | 2/2002 | Kline | H01R 13/6587 439/181 |
| 2004/0224559 | A1 * | 11/2004 | Nelson | H01R 13/514 439/607.05 |
| 2010/0015822 | A1 * | 1/2010 | Morgan | H01R 13/514 439/83 |
| 2015/0079842 | A1 * | 3/2015 | Pao | H01R 13/648 439/607.05 |

* cited by examiner

*Primary Examiner* — Jean F Duverne
(74) *Attorney, Agent, or Firm* — Clarence R. Moon

(57) ABSTRACT

A daughter card is constructed with a housing and a plurality of wafers retained in the housing. Each wafer includes a lead frame having a plurality of signal and ground terminals where the signal terminals are a differential pair. The lead frame includes an insulative frame portion with a conductive shield positioned on a side of the lead frame. The shield is secured to the lead frame by a projection extending from the shield to the ground terminals.

6 Claims, 13 Drawing Sheets

Attorney Docket No. B5-065 US

WAFER FOR ELECTRICAL CONNECTOR

RELATED APPLICATIONS

This application claims priority to U.S. Provisional Application No. 62/154,838, filed on Apr. 30, 2015 and U.S. Provisional Application No. 62/162,368, filed on May 15, 2015 which are both incorporated herein by reference in their entirety.

FIELD OF THE INVENTION

The disclosure relates to the field of connectors, more specifically to the field of connector suitable for high data rates.

DESCRIPTION OF RELATED ART

Backplane connectors are often used to support high performance applications. While backplane connectors originally were mostly used in single-ended channels applications, most recent designs have migrated to providing differential signal pairs (as differential signal pairs inherently have greater resistance to spurious signals). Backplane connectors that are used to support systems that use high data rates thus tend to be configured to utilize a number of differential signal pairs. Because different applications require different numbers of data channels, backplane connectors often are provided in a configuration that includes a header (which is mounted on a first circuit board) and a daughter card connector (which is mounted on a second circuit board) that supports a number of wafers (which in turn provides some desired number of signal pairs). The number of signal pairs in the wafer can be adjusted, as well as the size of the housing of the header and the size of the housing of the daughter card connector. Thus, existing backplane connectors are able to offer substantial benefits to applications that can benefit from the performance capabilities.

As processing power and the desired rate of information transfer from one device to other devices increases, however, further improvements to the performance of backplane connectors will be helpful. In addition to performance improvements, extremely dense connectors (e.g., connectors with a large number of pins per area) are desirable. Thus, certain individuals would appreciate further improvements to connectors that are suitable to function as backplane connectors

BRIEF SUMMARY

In an embodiment, a connector system is disclosed that includes a first and second connector. The first connector includes a housing that supports a plurality of signal and ground terminals. The terminals are arranged in an array and are configured to be retained in the housing and extend into a receiving bay. The second connector includes one or more wafers that support terminals arranged in an edge-coupled manner. Each wafer can include a shield and the ground terminal with the ground terminal and the shield electrically connected together.

In an embodiment, a connector is provided that includes a housing that supports a plurality of wafers. The wafers can include a shield and support a plurality of signal terminals, which are provided in pairs, and ground terminals positioned between the pairs of signal terminals. The shield can be electrically connected to the ground terminals. The ground terminals can include openings spaced along the body portion of the ground terminal and the shield can include a plurality of projections extending in a lateral direction that are received in the openings formed in the ground terminals electrically connecting the shield to the ground terminals.

BRIEF DESCRIPTION OF THE DRAWINGS

The present disclosure is illustrated by way of example and not limited in the accompanying figures in which like reference numerals indicate similar elements and in which.

DETAILED DESCRIPTION

FIGS. 1-17 illustrate an embodiment of the disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the disclosure.

One or more embodiments of the disclosure utilize a wafer construction for the transmission of signal and ground across and electrical connector. The configuration generally consists of a backplane connector with a corresponding mating daughter card connector for a board to board connection.

Figure 1:
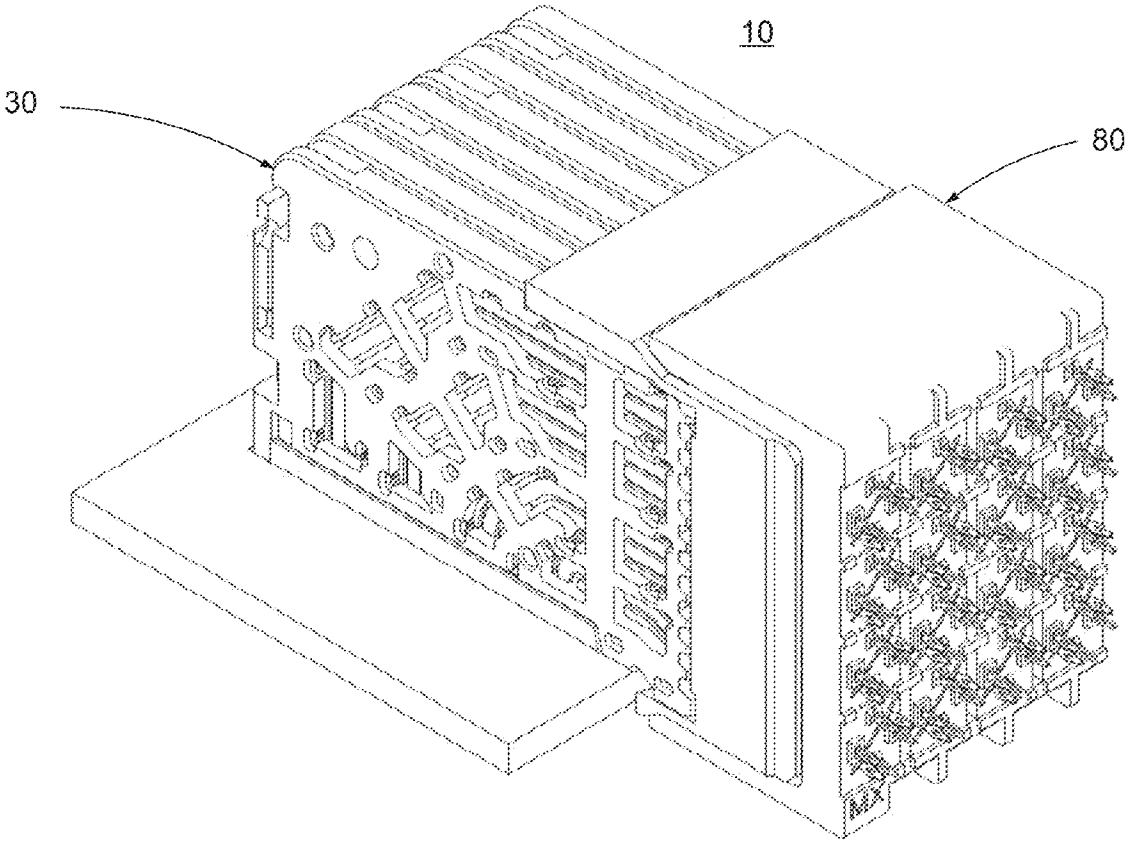
FIG. 1 is a perspective view of the electrical connector system.
Figure 2:
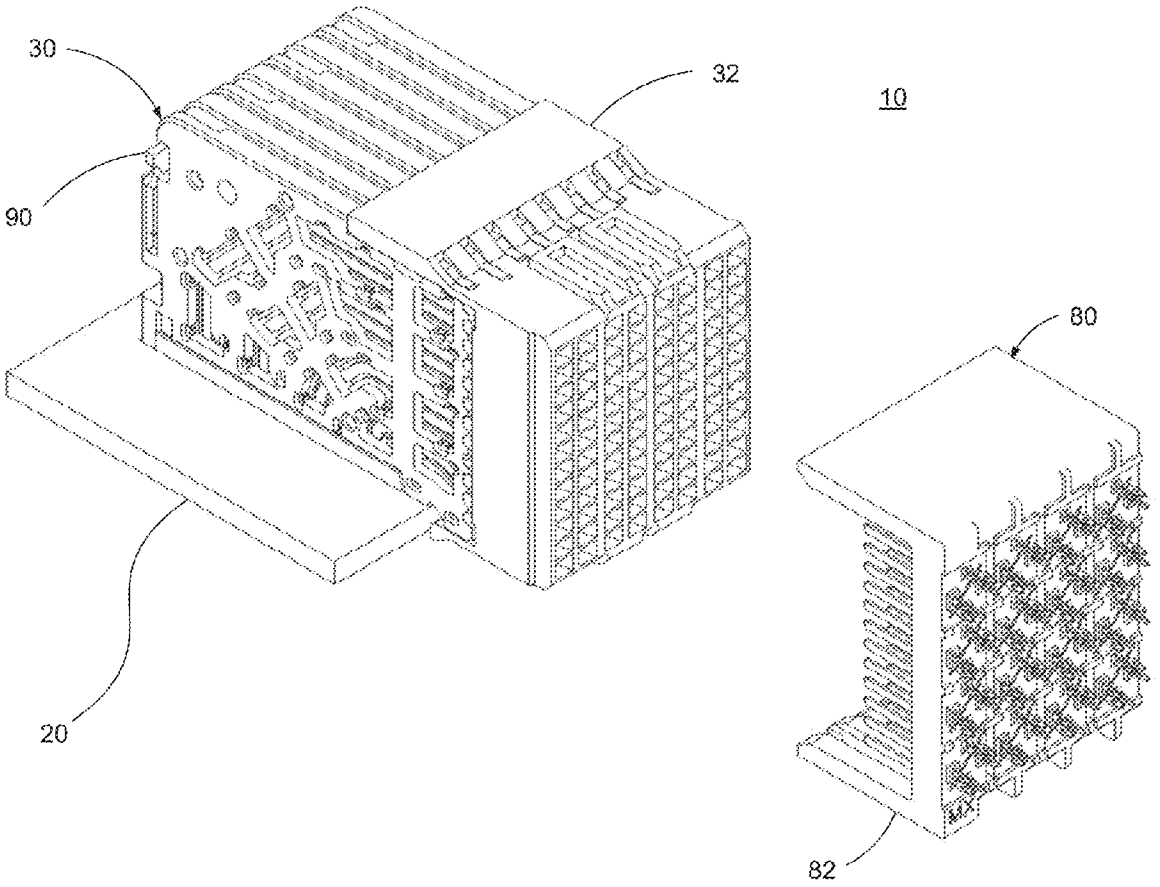
FIG. 2 is a perspective view of the electrical connector system of FIG. 1 in an unmated condition.
Figure 3:
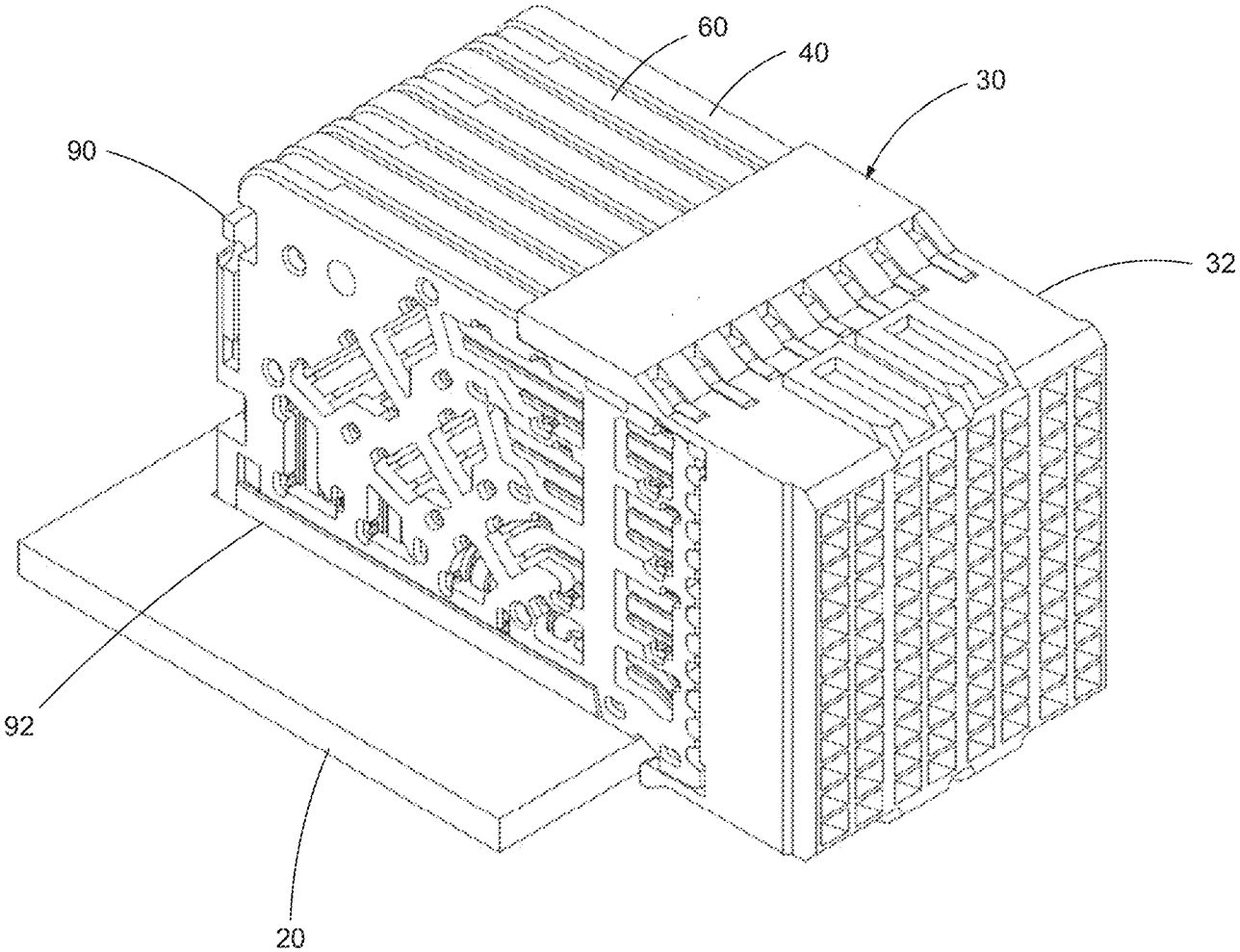
FIG. 3 is a perspective view of the daughter card connector of the electrical connector system of FIG. 1.

As illustrated in the FIGS. 1-3 an embodiment of a board-to-board connector assembly 10 including a plurality of connecting portions. The connector system is configured to include individual connecting portions of both signal and ground types that are disposed in a wafer and is configured in a linear arrangement of multiple wafers. In this embodiment, a board to board arrangement is depicted with a vertical plug connector and a right angle receptacle connector, but alternate arrangements can be appreciated.

In the embodiment shown, the board to board connector assembly 10 includes a plug connector 80 typically referred to as a backplane and the receptacle connector 30 typically referred to as a daughter card. Individual connecting terminals of the backplane are arranged in an array and held within a housing 32. As shown a typical daughter card generally is comprised of a series of over-molded wafers 40, 60 having a number of signal and ground circuits held within a housing 32. The wafers are retained within slots formed in a receiving portion of a housing 32 generally and secured together by a stiffener 90. A tail aligner plate 92 is fixed to the wafers having a plurality of openings for allowing the tails to pass through and engage a conductive hole in a circuit board 20.

Figure 4:
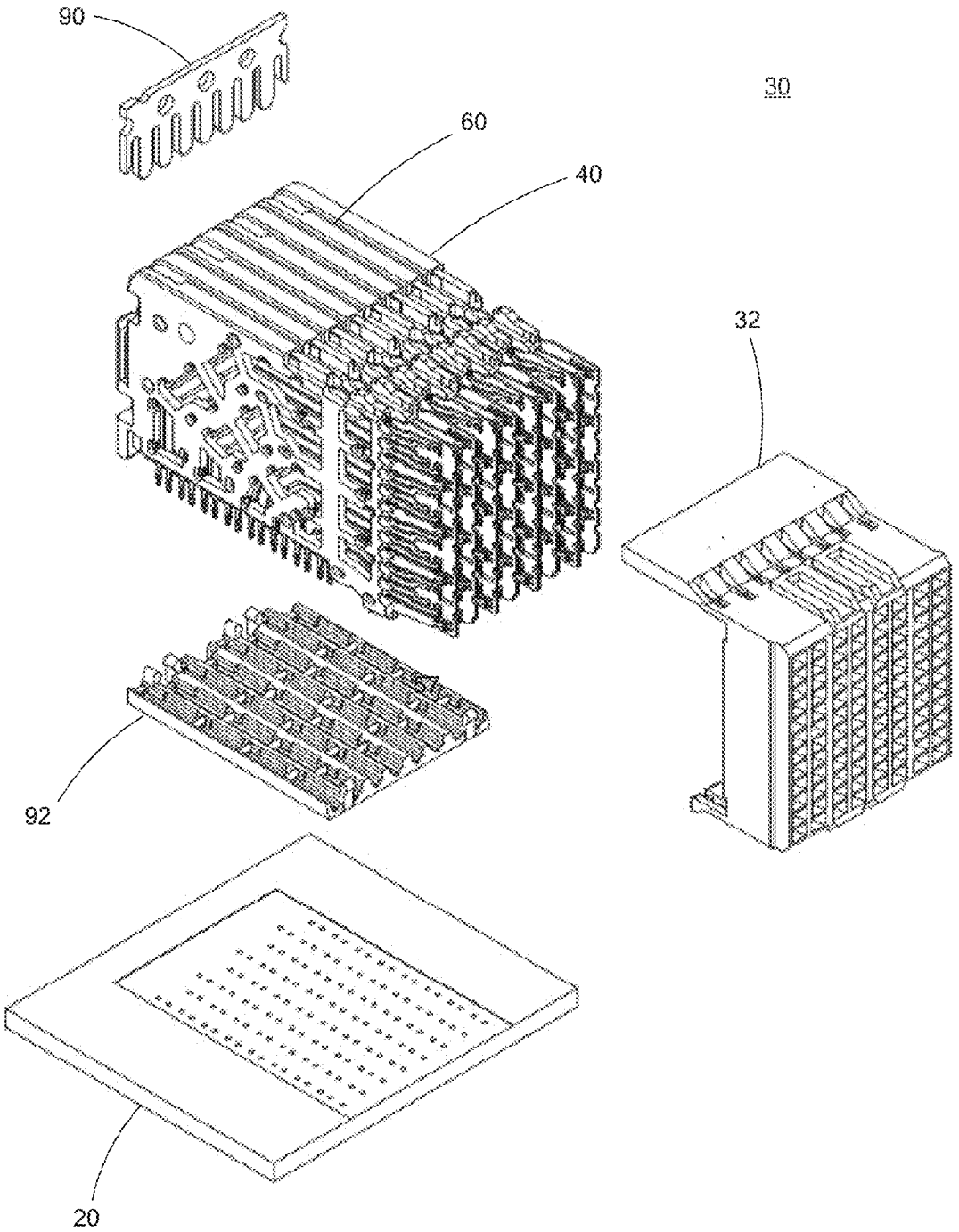
FIG. 4 is an exploded view of the daughter card connector of the electrical connector system of FIG. 1.
Figure 5:
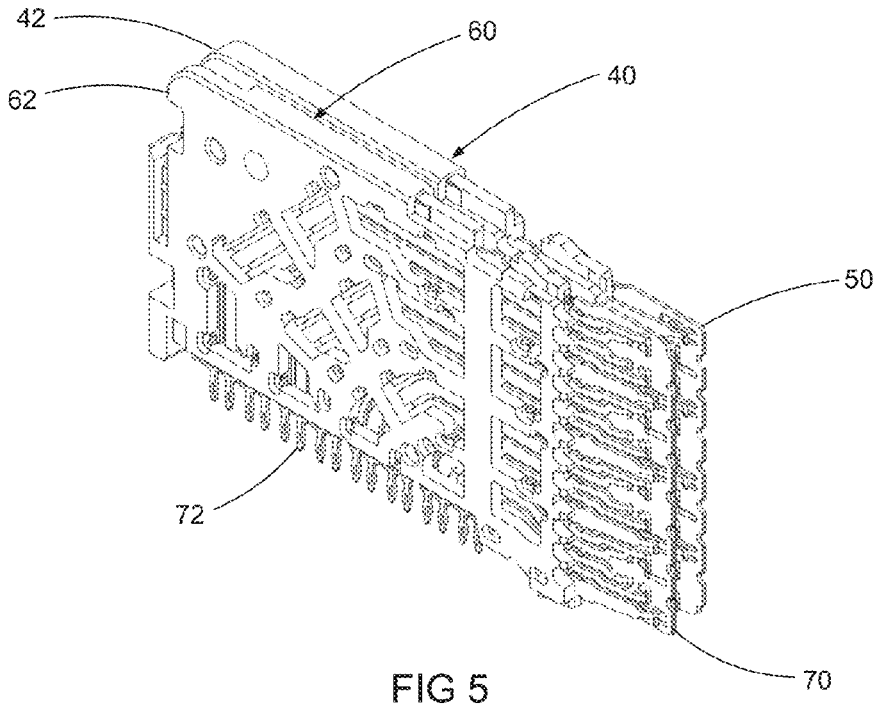
FIG. 5 is a perspective view of a wafer pair of the electrical connector of FIG. 1.
Figure 6:
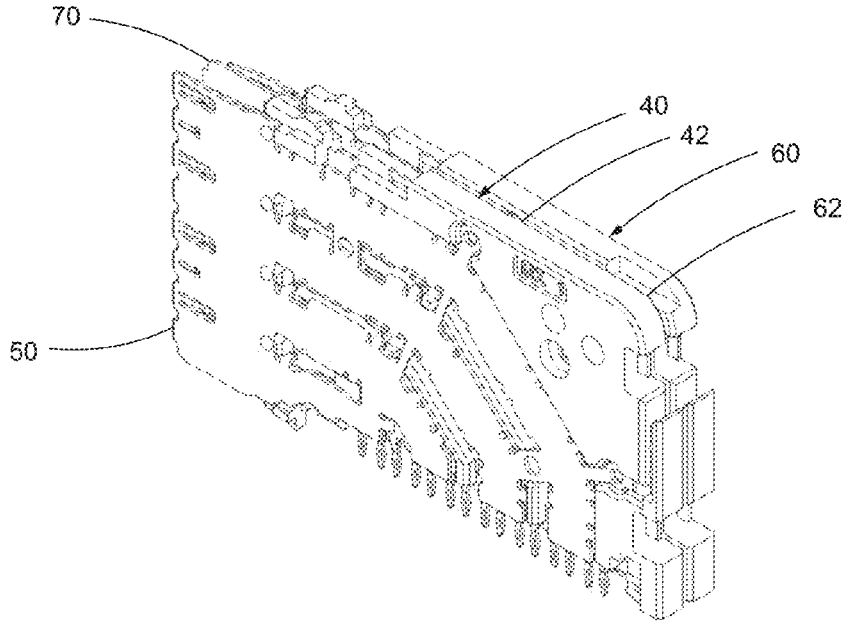
FIG. 6 is an alternative perspective view of the wafer pair of the electrical connector of FIG. 1.
Figure 7:
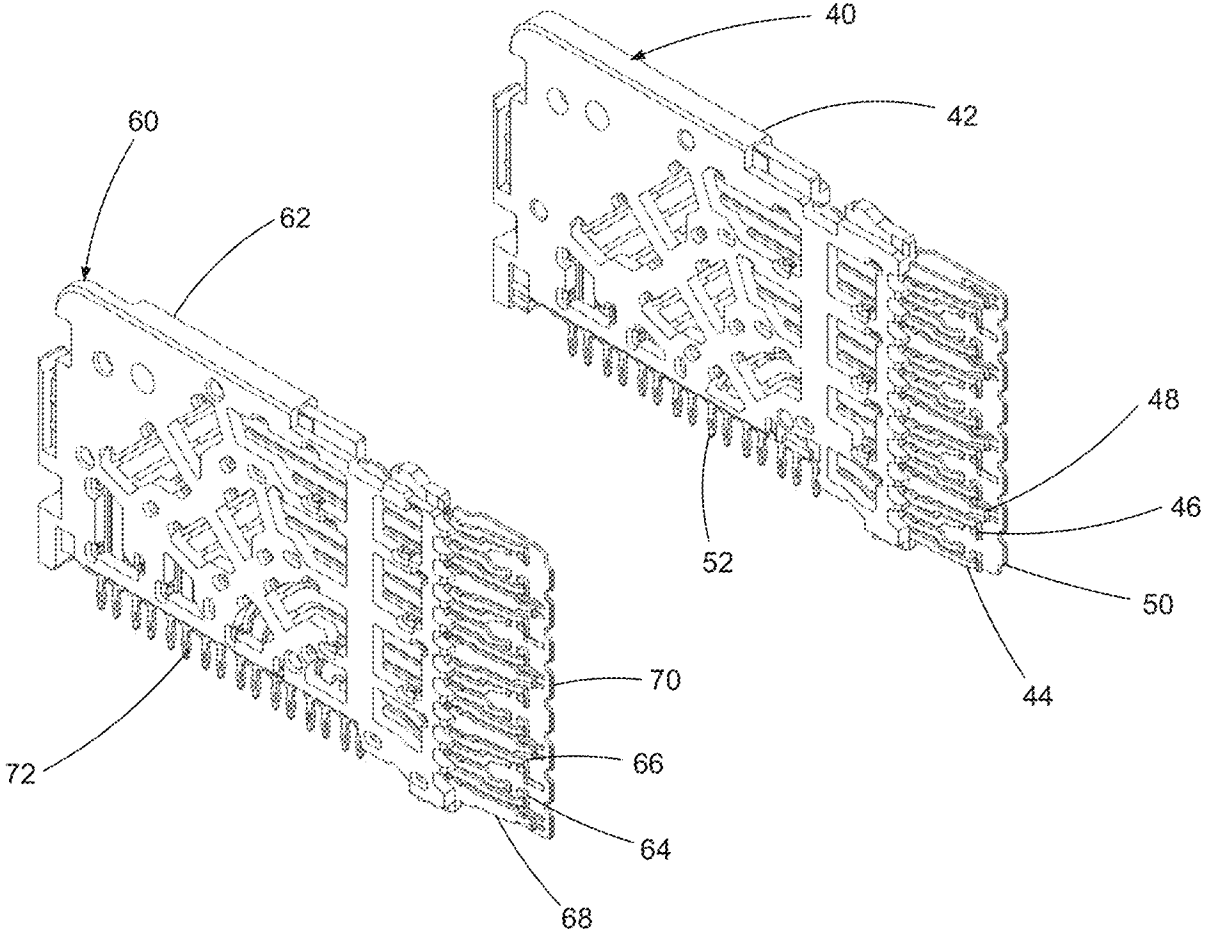
FIG. 7 is an explode view of the wafer pair of FIG. 5.
Figure 8:
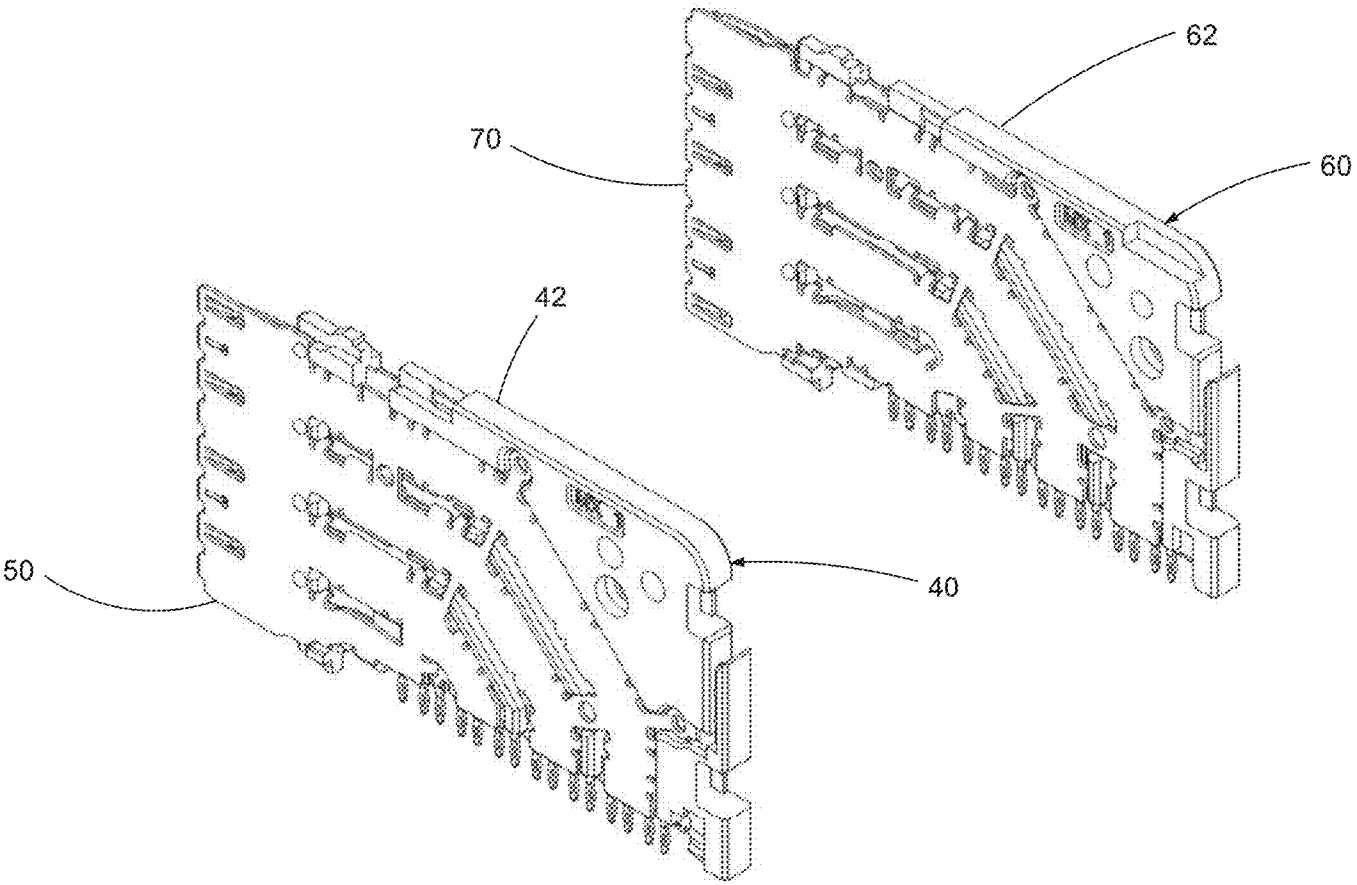
FIG. 8 is an alternative view of the wafer pair of FIG. 7.

As best shown in FIGS. 3 to 4 the daughter card 30 includes a housing 32 and a plurality of signal wafers 40, 60 arranged in a side by side relationship and received in the housing 32. The housing 32 includes a mating surface at one end of the housing 32 and a receiving portion formed at the other end of the housing 32 that includes a series of slots formed within the receiving portion. Multiple pairs of wafers 40, 60 and arranged adjacently along the length of the assembly and correspond to the slots formed in the housing 32. The modularity aspect of this construction allows multiple circuit size assemblies to be created by selecting the appropriate number of wafers that the specific application requires.

As illustrated in FIGS. 5-8 in the embodiment a first wafer 40 and a second wafer 60 are arranged side by said manner in an alternating pattern. The first wafer 40 and the second wafer 60 are similarly construction but differ in the position of the signal and ground terminals 68 between adjacent wafers of the wafer pair 40, 60. That is, the signal and ground terminals 68 of the first wafer 40 are vertically offset from respective signal and ground terminals 68 of the adjacent second wafer 60 therefore creating a staggered relationship between the wafers 40, 60. This pattern is continued along the entire length of the connector assembly.

Figure 9:
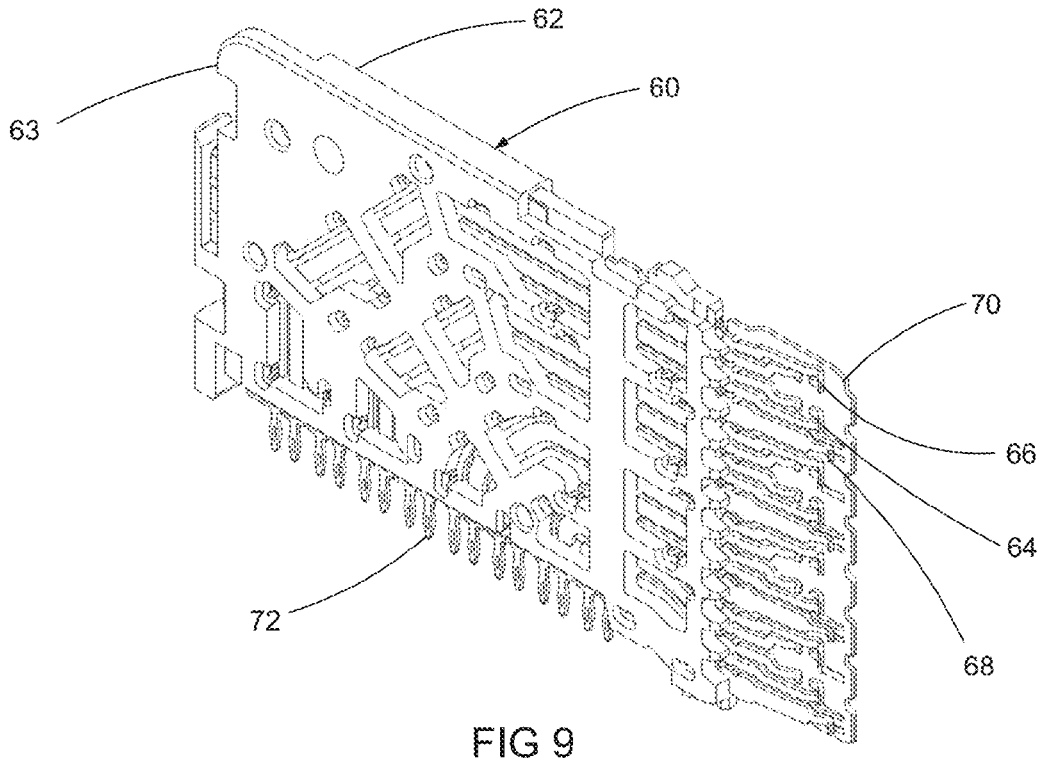
FIG. 9 is a perspective view of a single wafer of FIG. 7.
Figure 10:
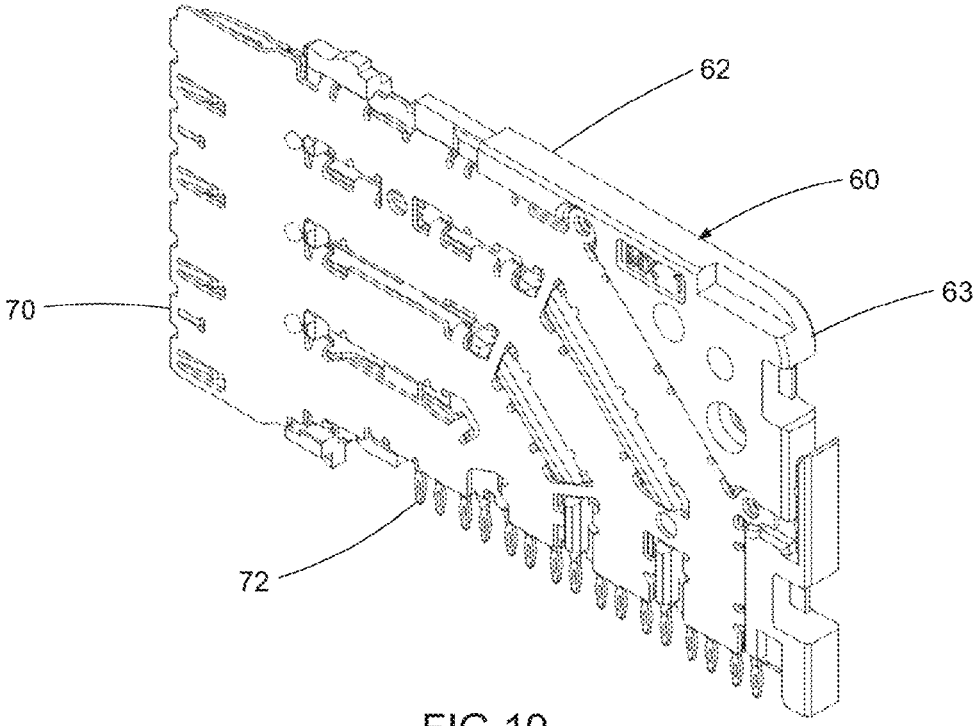
FIG. 10 is an alternative perspective view of the wafer of FIG. 9.
Figure 11:
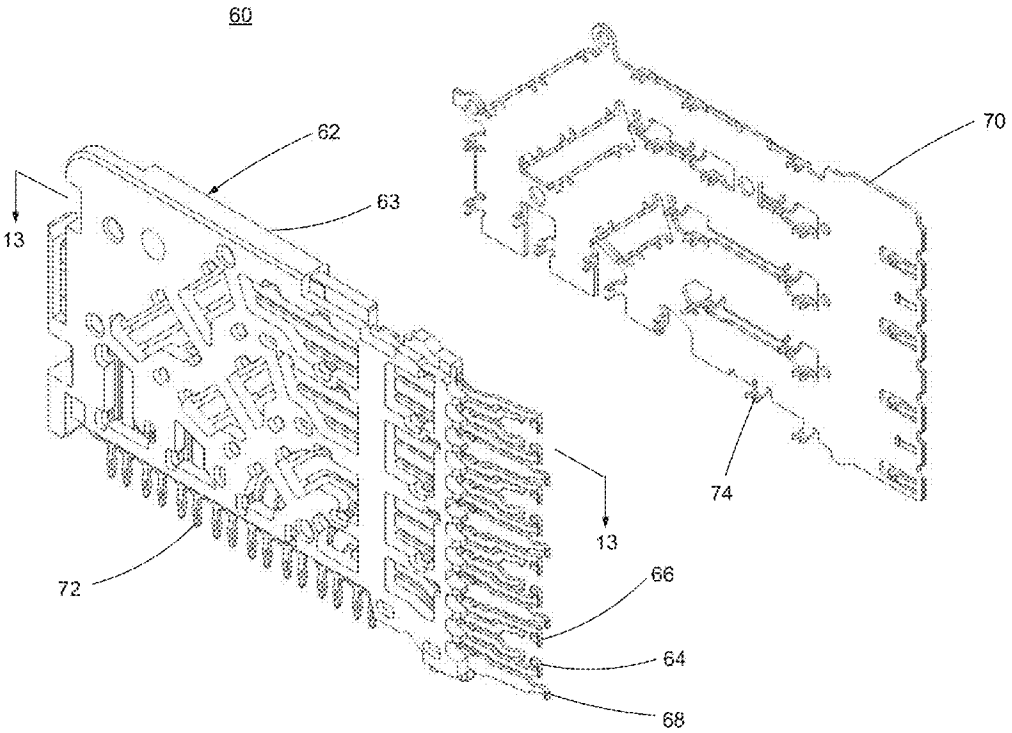
FIG. 11 is an exploded view of the wafer of FIG. 9.

As illustrated in FIGS. 9 to 11, a single wafer 60 is described and includes a lead frame 62 and a shield 70 that are married together with the shield arranged on a side of the lead frame. The lead frame 62 includes an insulative support structure 63 and a plurality of conductive terminals 64, 66 and 68 and held within a carrier. The terminals are arranged in a column and consist of multiple pairs of differential signal terminals with a ground terminal 68 disposed between the differential pairs. The lead frame 62 is constructed by stamping and forming the conductive terminals 64, 66 and 68 in a die with all the terminals linked together by the carrier. The insulative frame 63 is molded over the terminals and secures the terminals 64, 66 and 68 in place at their respective proper positions. The connecting portions of the carrier that link and hold the terminals 64, 66 and 68 together during molding are removed by a punching which singulates each of the terminals 64, 66 and 68.

Each signal terminal 64, 66 is constructed having a body potion with a connection portion formed at a first end of the body portion and a mounting end formed at another end of the body portion. In the embodiment shown, each terminal is shown as a right angle type terminal, that is, the connection portion and the mounting portion at orientate at right angles to each other. The connection portion has a flexible contacting portion that engages a corresponding terminal pin on the backplane connector. The mounting portion includes a tail that is inserted into a conductive hole in a printed circuit board 20. In the embodiment the tail 72 includes a compliant section that upon insertion into the conductive hole, maintains a spring force against the conductive portion for electrical contact.

The ground terminal 68 is similarly constructed and includes a body portion, a connection portion at a first end of the body portion and a mounting end formed at another end of the body portion wherein the connection portion and the mounting portion are orientated at right angles to each other. The ground terminal 68 further includes a plurality of holes 76 formed in the body portion. In the embodiment the holes 76 are generally rectangular with a pair of opposing edge portions but other hole geometries can be appreciated.

Figure 12:
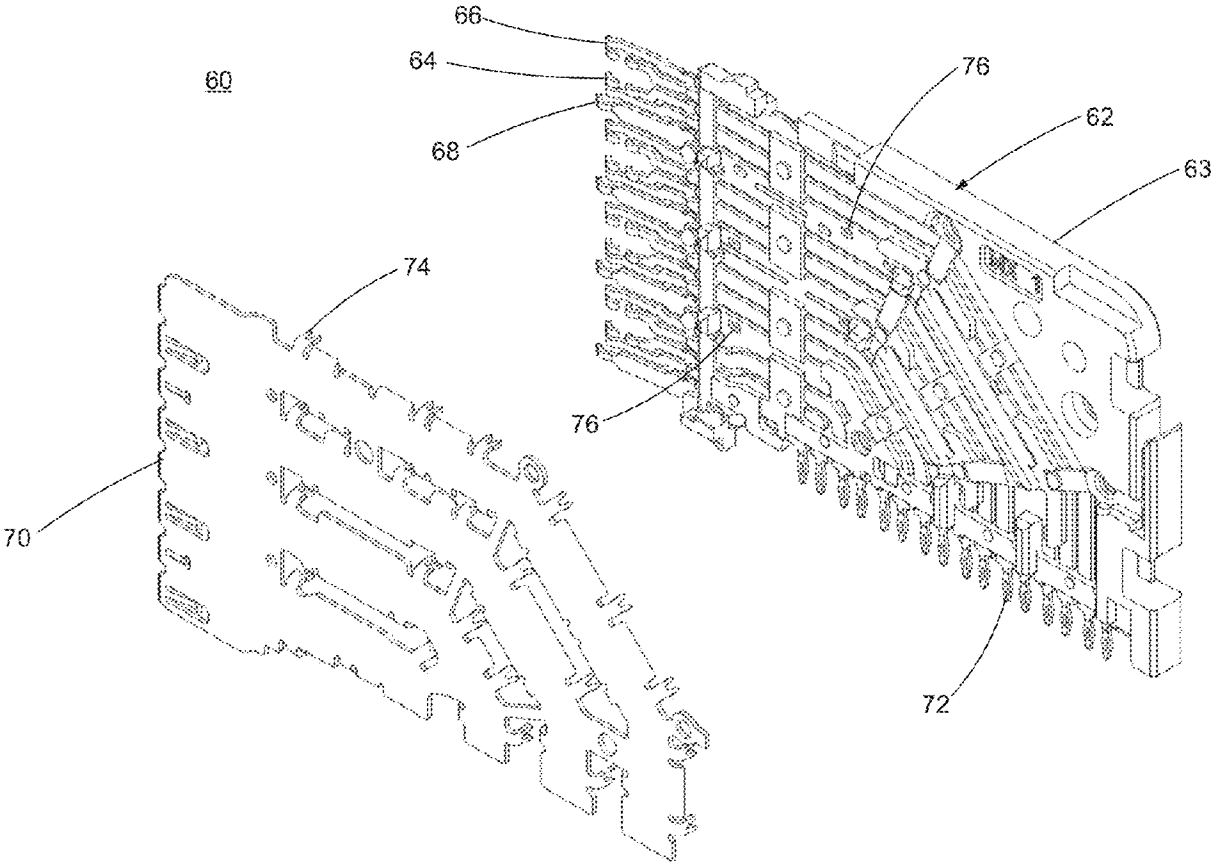
FIG. 12 is a reverse perspective of the wafer of FIG. 11.

As depicted in FIGS. 11 and 12 a shield is stamped and formed from a conductive sheet and is formed as a flat plate. The shield includes a connection portion including spring contacting portions for engaging corresponding terminal pins of the backplane connector. The shape of the shield conforms to an exterior outline of the conductive terminals of the lead frame, in other words, the shield has a shape that overlays or envelopes the conductive terminals, in particular, the differential signal terminals of the lead frame. Stated otherwise, the shield shadows the differential signals. The shield further includes a plurality of projections 74 extending laterally form the shield that are aligned with the holes 76 formed in ground terminals 68 of the lead frame 62.

Figure 13:
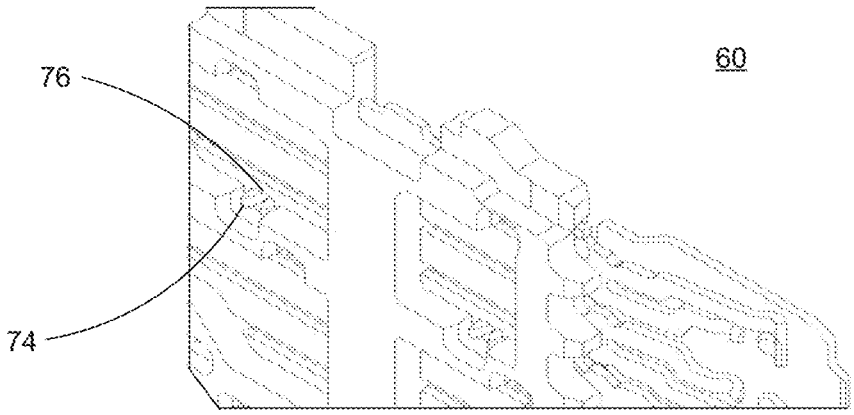
FIG. 13 is a detailed view of the wafer of FIG. 9.
Figure 14:
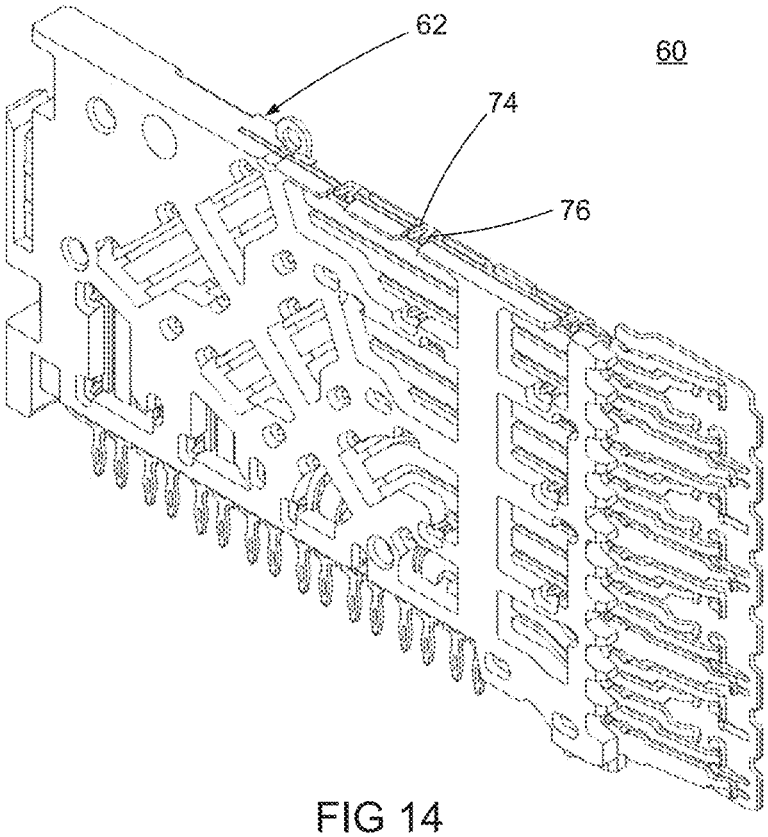
FIG. 14 is a section view of the wafer of FIG. 9.
Figure 15:
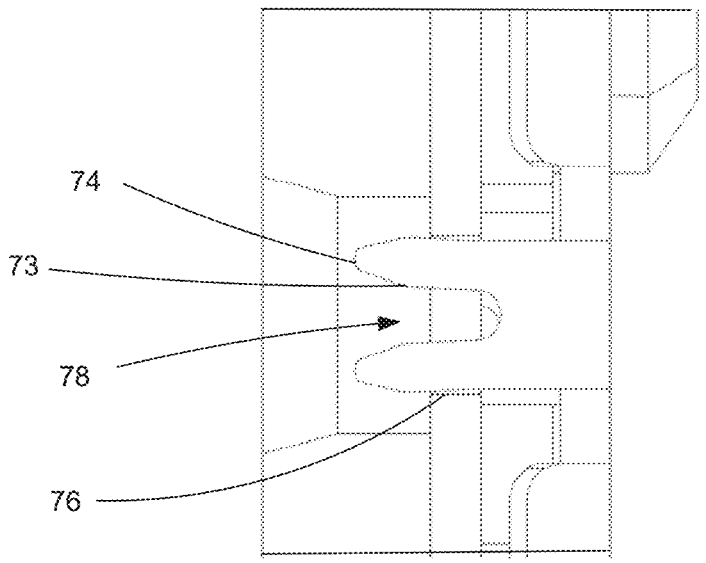
FIG. 15 is a detailed section view of the wafer of claim 9.
Figure 16:
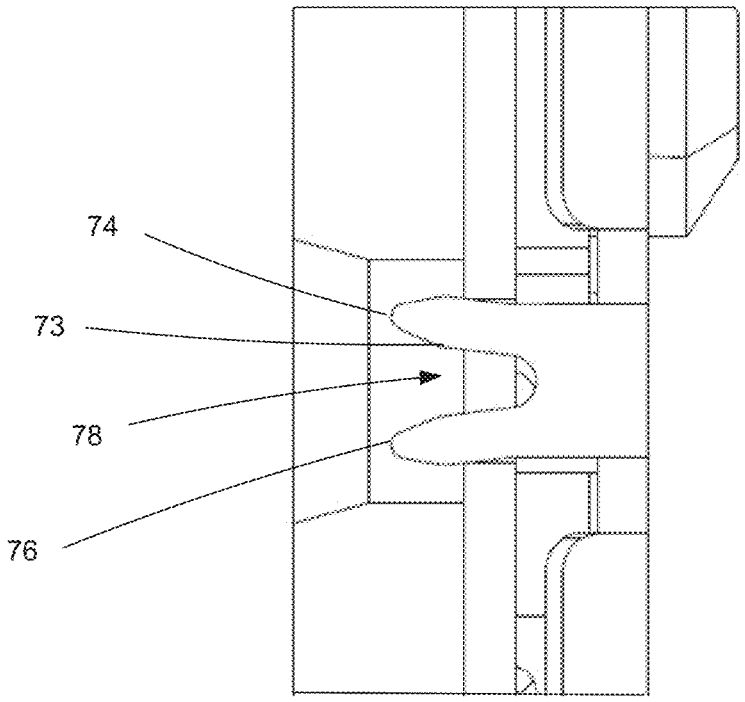
FIG. 16 is another detailed section view of the wafer of FIG. 9.

As shown in FIGS. 13-14 during assembly of the wafer 60, the shield 70 is married to the lead frame 62 by layering the shield 70 to the side of the lead frame 62. The projections 74 formed on the shield 70 are aligned with the holes 76 in the ground terminals 68 and extend through the body portion of the terminal 68. As shown in FIG. 15, the projection 74 includes a pair of fingers 73 having a middle space 78. The hole 76 in the ground terminal 68 is formed so as to allow the fingers 73 to pass through the holes 76 without any interference. Upon assembly of the shield 70 to the lead frame 62, the spring fingers 73 are deformed outward, or the space between the fingers 73 is enlarged causing the side portions of the fingers 73 to engage the edges of the holes 76 facilitating electrical connection and commoning the shield 70 to the ground terminals 68 as depicted in FIG. 16. Alternatively, the fingers 73 may be deformed laterally with respect to each other, that is, the fingers are bend in a direction that is angled from a plane defined between the fingers. In an alternative embodiment the fingers 73 are formed having a larger width between the side portions of the fingers 73 than the edge portions of the holes 76. During assembly, the fingers 73 are aligned with the holes 76 and maintain electrical connection during the marriage of the shield 70 to the lead frame by spring force.

Figure 17:
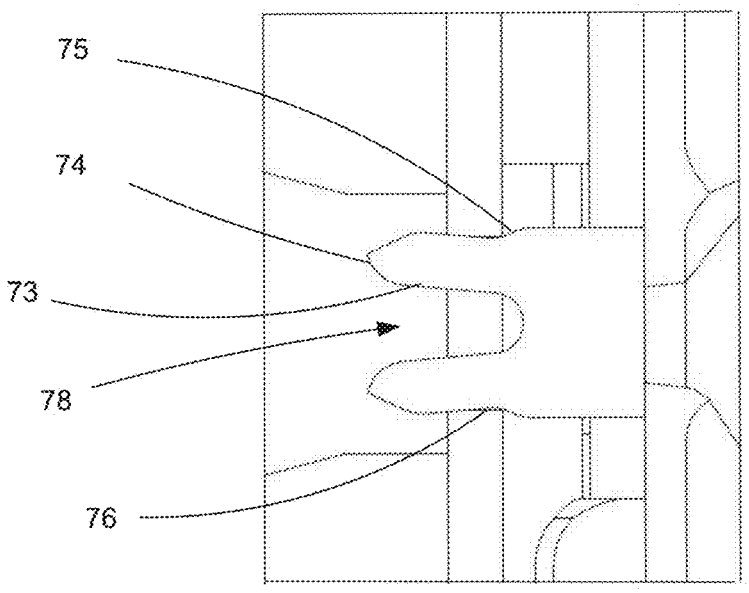
FIG. 17 is a detailed section view of another embodiment of the wafer.

An alternative embodiment is shown in FIG. 17 in which the projection 74 includes a pair of fingers 73 with an intervening space 78 with a tapered transition portion 75 formed at the base of the fingers 73. During the assembly of the wafer 60 as described above, the tapered transition portion 75 providers a biasing force to the shield 70 upon the deformation of the fingers 73. In other words, as the middle space 78 is enlarged, the portion of the fingers 73 that extend beyond the ground terminal 68, urge the ground terminal 68 toward the shield 70 with the holes 76 engaging the tapered transition portion 75. The tapered transition portion 75 provides resistance by camming the ground terminal 68 away from the shield 70 and therefore clamping the ground terminal 68 and eliminating any potential for slop or a loose fitting connection between the ground terminal 68 and the shield 70.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of connectors. Also, there are many possible variations in the materials and configurations.

We claim:

1. A wafer comprising:

a lead frame, the lead frame including a plurality of signal terminals and a plurality of ground terminals, the ground terminals having a body portion, a mounting portion disposed at a first end of the body portion and a connection portion disposed at a second end of the body portion, the ground terminal including an opening formed in the body portion with the opening including opposing edges; and a shield disposed on a side of the lead frame, a projection extending from the shield, the projection includes a pair of fingers with a space between the fingers, each finger having a side portion that engages the edges of the opening in the ground terminal.

2. The wafer of claim 1, wherein the fingers are deformed by enlarging the space.

3. The wafer of claim 1, wherein a transition section is formed at the base of the fingers.

4. The wafer of claim 3, wherein the transition is position abuts the edges of the opening.

5. A method for producing a wafer comprising:

providing lead frame, having a pair of signal terminals and a ground terminal, the ground terminal having a hole with opposing edges;

molding a housing over the lead frame;

placing a shield over a side of the lead frame, the shield including a projection, the projection having a pair of spaced apart fingers, each finger having a side portion; and securing the shield to the lead frame wherein the side portions of each finger of the projection engages the opposing edges of the hole in the ground terminal.

6. The method for producing a wafer according to claim 5, wherein securing the shield to the wafer is accomplished by deforming the side portions of the projection.

* * * * *